US009779739B2

(12) United States Patent
Kalker et al.

(10) Patent No.: US 9,779,739 B2
(45) Date of Patent: Oct. 3, 2017

(54) RESIDUAL ENCODING IN AN OBJECT-BASED AUDIO SYSTEM

(71) Applicant: DTS, Inc., Calabasas, CA (US)

(72) Inventors: Antonius Kalker, Mountain View, CA (US); Gadiel Seroussi, Cupertino, CA (US)

(73) Assignee: DTS, Inc., Calabasas, CA (US)

( * ) Notice: Subject to any disclaimer, the term of this patent is extended or adjusted under 35 U.S.C. 154(b) by 0 days.

(21) Appl. No.: 14/620,544

(22) Filed: Feb. 12, 2015

(65) Prior Publication Data

US 2015/0269951 A1 Sep. 24, 2015

Related U.S. Application Data

(60) Provisional application No. 61/968,111, filed on Mar. 20, 2014.

(51) Int. Cl.
*G10L 19/008* (2013.01)

(52) U.S. Cl.
CPC ..... *G10L 19/008* (2013.01)

(58) Field of Classification Search
CPC .... A61K 31/43; A61K 2300/00; A61K 31/42; A61K 31/424; A61K 9/2081
USPC ..... 704/500; 381/22
See application file for complete search history.

(56) References Cited

U.S. PATENT DOCUMENTS

| | | | |
|---|---|---|---|
| 7,617,110 | B2 | 11/2009 | Kim et al. |
| 8,386,271 | B2 | 2/2013 | Koishida et al. |
| 2007/0002971 | A1 | 1/2007 | Purnhagen et al. |

(Continued)

FOREIGN PATENT DOCUMENTS

| | | | |
|---|---|---|---|
| WO | 2012125855 | A1 | 9/2012 |

OTHER PUBLICATIONS

International Search Report and the Written Opinion of the International Searching Authority, or the Declaration, date of mailing Jul. 24, 2015, in related PCT Application No. PCT/US2015/018804, 16 pages.

(Continued)

*Primary Examiner* — Charlotte M Baker
(74) *Attorney, Agent, or Firm* — Craig Fischer; William Johnson

(57) ABSTRACT

Lossy compression and transmission of a downmixed composite signal having multiple tracks and objects, including a downmixed signal, is accomplished in a manner that reduces the bit-rate requirement as compared to redundant transmission or lossless compression, while reducing upmix artifacts. A compressed residual signal is generated and transmitted along with a compressed total mix and at least one compressed audio objects. In the reception and upmix aspect the invention decompresses a downmixed signal and other compressed objects, calculates an approximate upmix signal, and corrects specific base signals derived from the upmix, by subtracting a decompressed residual signal. The invention thus allows lossy compression to be used in combination with downmixed audio signals for transmission through a communication channel (or for storage). Upon later reception and upmix, additional base signals are recoverable in capable systems providing multi-object capability (while legacy systems can easily decode a total mix without upmix).

27 Claims, 2 Drawing Sheets

(56) References Cited

U.S. PATENT DOCUMENTS

| | | | | |
|---|---|---|---|---|
| 2007/0043575 | A1* | 2/2007 | Onuma | G10L 19/0017 704/500 |
| 2007/0223708 | A1 | 9/2007 | Villemoes et al. | |
| 2007/0225842 | A1 | 9/2007 | Smith et al. | |
| 2009/0110203 | A1 | 4/2009 | Taleb | |
| 2009/0177478 | A1 | 7/2009 | Jax et al. | |
| 2009/0262957 | A1 | 10/2009 | Oh et al. | |
| 2009/0326958 | A1 | 12/2009 | Kim et al. | |
| 2010/0014692 | A1 | 1/2010 | Schreiner et al. | |
| 2010/0106271 | A1 | 4/2010 | Oh et al. | |
| 2012/0230497 | A1* | 9/2012 | Dressler | H04S 3/02 381/22 |

OTHER PUBLICATIONS

International Preliminary Report on Patentability, in related PCT Application No. PCT/US2015/018804, 10 pages.

* cited by examiner

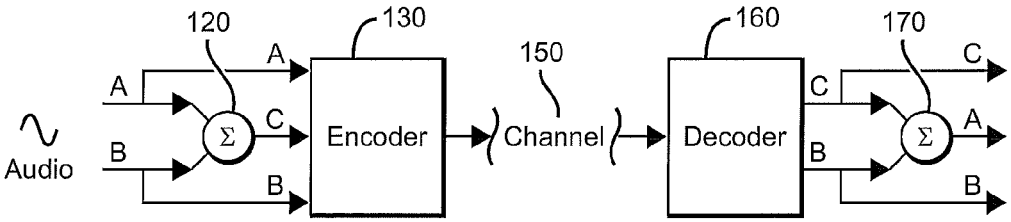
FIG. 1
PRIOR ART
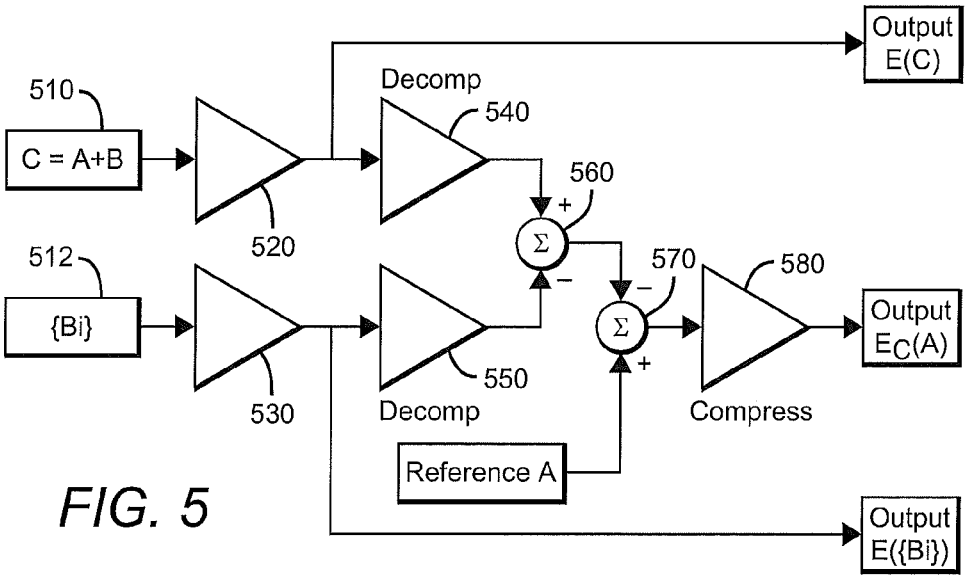
FIG. 5
FIG. 6
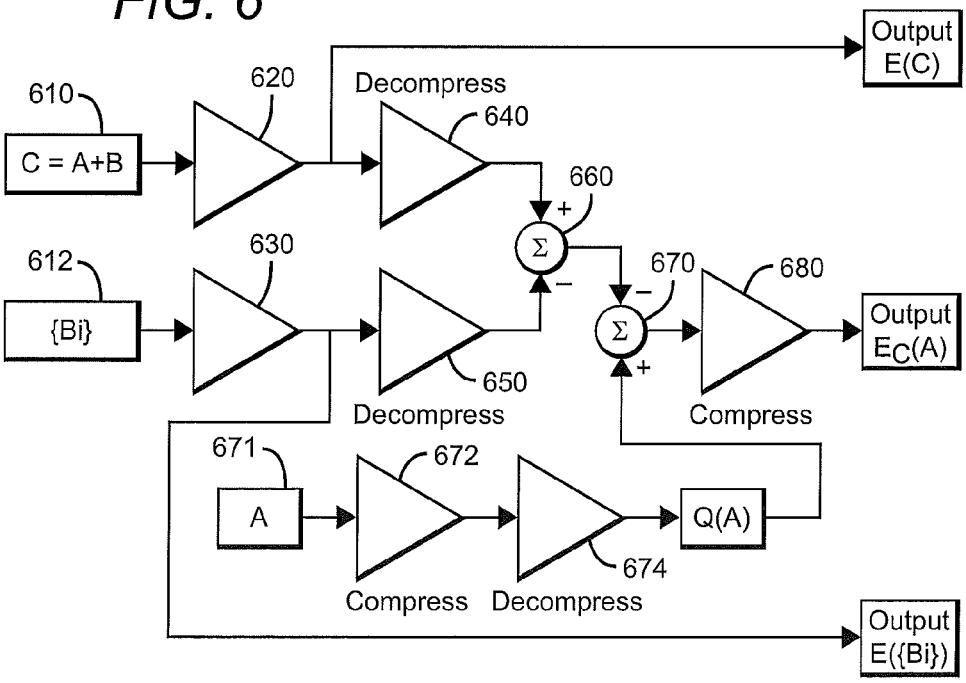

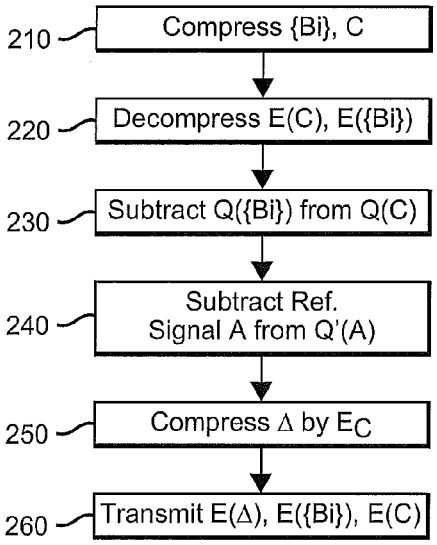
FIG. 2
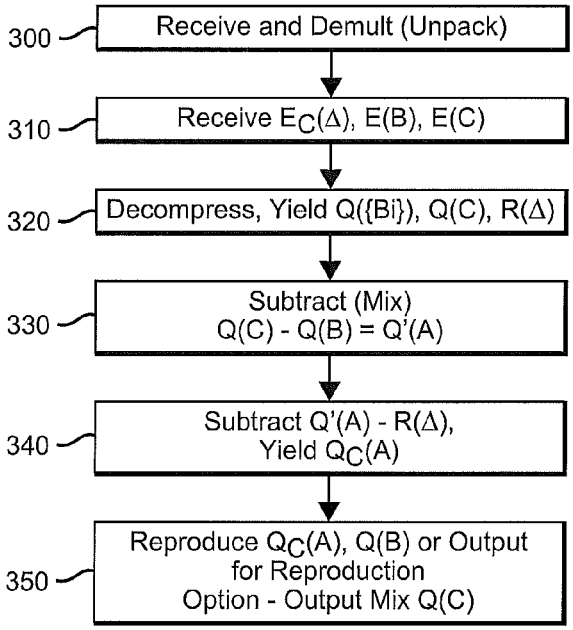
FIG. 3
FIG. 4
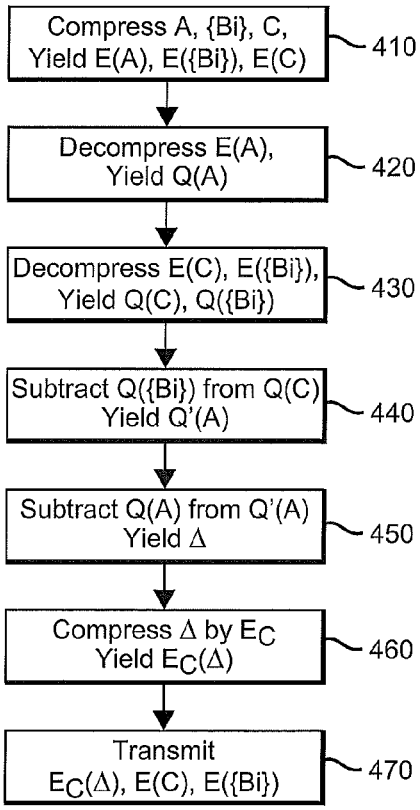

RESIDUAL ENCODING IN AN OBJECT-BASED AUDIO SYSTEM

RELATED APPLICATIONS

This application claims priority to provisional patent application Ser. No. 61/968,111 filed 20 Mar. 2014 and entitled "Residual Encoding in an Object-Based Audio System."

BACKGROUND OF THE INVENTION

1. Field of the Invention

This invention relates generally to lossy, multi-channel audio compression and decompression generally, and more specifically to compression and decompression of downmixed, multi-channel audio signals in a manner that facilitates upmix of the received and decompressed multi-channel audio signals.

2. Description of the Related Art

Audio and audio-visual entertainment systems have progressed from humble beginnings, capable of reproducing monaural audio through a single speaker. Modern surround-sound systems are capable of recording, transmitting, and reproducing a plurality of channels, through a plurality of speakers in a listener environment (which may be a public theater or a more private "home theater."). A variety of Surround sound speaker arrangements are available: these go by such designations as "5.1 surround," "7.1 surround," and even 20.2 surround (where the numeral to the right of the decimal point indicates a low frequency effects channel). For each such configuration, various physical arrangements of speakers are possible; but in general the best results will be realized if the rendering geometry is similar to the geometry presumed by the audio engineers who mix and master the recorded channels.

Because various rendering environments and geometries are possible beyond the prediction of the mixing engineers, and because the same content may be played back in diverse listening configurations or environments, the multiplicity of surround sound configurations presents numerous challenges to the engineer or artist wishing to deliver a faithful listening experience. Either a "channel-based" or (more recently) an "object-based" approach may be employed to deliver the surround sound listening experience.

In a channel-based approach, each channel is recorded with the intention that it should be rendered during playback on a corresponding speaker. The physical arrangement of the intended speakers is predetermined or at least approximately assumed during mixing. In contrast, in an object-based approach a plurality of independent audio objects are recorded, stored, and transmitted separately, preserving their synchronous relationship, but independent of any presumptions about the configuration or geometry of the intended playback speakers or environment. Examples of audio objects would be a single musical instrument, an ensemble section such as a viola section considered as a unitary musical voice, a human voice, or a sound effect. In order to preserve spatial relationships, the digital data representing the audio objects includes for each object certain data ("metadata") symbolizing information associated with the particular sound source: for example, the vector direction, proximity, loudness, motion, and extent of the sound source can be symbolically encoded (preferably in a manner capable of time variation) and this information is transmitted or recorded along with the particular sound signal. The combination of an independent sound source waveform and the associated metadata together comprise an audio object (stored as an audio object file). This approach has the advantage that it can be rendered flexibly, in many different configurations; however, the burden is placed on the rendering processor ("engine") to calculate the proper mix based on the geometry and configuration of the playback speakers and environment.

In both channel-based and object-based approaches to audio, it is frequently desirable to transmit a downmixed signal (A plus B) in such a way that the two independent channels (or objects, A and B) may be separated ("upmixed") during playback. One motivation to transmit a downmix might be to keep backward compatibility, so that a downmixed program can be played on monaural, conventional two-channel stereo, or (more generally) on a system with fewer speakers than the number of channels or objects in the recorded program. In order to recover the higher plurality of channels or objects, an upmixing process is employed. For example, if one transmits the sum C of signals A and B (A+B), and if one also transmits B, then the receiver can easily construct A (A+B−B)=A. Alternatively, one may transmit composite signals (A+B) and (A−B), then recover A and B by taking linear combinations of the transmitted composite signals. Many prior systems use variations of this "matrix mixing" approach. These are somewhat successful at recovering discrete channels or objects. However, when large numbers of channels or especially objects are summed, it becomes difficult to adequately reproduce individual discrete objects or channels without either artifacts or impractically high bandwidth requirements. Because object-based audio often involves very high numbers of independent audio objects, great difficulties are involved in effective upmixing to recover discrete objects from downmixed signals, particularly where data-rate (or more generally, bandwidth) is constrained.

In most practical systems for transmission or recording of digital audio, some method of data compression will be highly desirable. Data rate is always subject to some constraint, and it is always desired to transmit audio more efficiently. This consideration becomes increasingly important when a large number of channels are employed—either as discrete channels or upmixed. In the present application the term "compression" refers to methods of reducing data requirement to transmit or record audio signals, whether the result is data-rate reduction or file size reduction. (This definition should not be confused with dynamic range compression, which is also sometimes referred to as "compression" in other audio contexts not relevant here).

Prior approaches to compressing downmixed signals generally adopt one of two methods: Lossless coding or redundant description. Either can facilitate upmix after decompression, but both have drawbacks.

Lossless and Lossy Coding:

Assume A, $B_1$, $B_2$, . . . , $B_m$ are independent signals (objects), which are encoded in a code stream and sent to a renderer. Distinguished object A will be referred to as the base object, while $B=B_1, B_2, \ldots, B_m$ will be referred to as regular objects. In an object-based audio system, we are interested in rendering objects simultaneously but independently, so that, for example, each object could be rendered at a different spatial location.

Backward compatibility is desirable: in other words, we require that the coded stream be interpretable by legacy systems that are neither object-based nor object-aware, or which are capable of fewer channels. Such systems can only render the composite object or channel $C=A+B_1+B_2+\ldots+B_m$ from an encoded (compressed) version, E(C), of C. Therefore, we require that the code stream include E(C) be transmitted, followed by descriptions of the individual objects, which are ignored by the legacy systems. Thus, the code stream may consist of E(C) followed by descriptions $E(B_1), E(B_2), \ldots, E(B_m)$ of the regular objects. The base object A is then recovered by decoding these descriptions and setting $A=C-B_1-B_2-\ldots-B_m$. It should be noted, however, that most audio codecs used in practice are lossy, meaning that the decoded version Q(X)=D(E(X)) of a coded object E(X) is only an approximation of X, and thus not necessarily identical to it. The accuracy of the approximation generally depends on the choice of codec and on the bandwidth (or storage space) available for the code stream. While a lossless encoding is possible, i.e. Q(X)=X, it usually requires significantly larger bandwidth or storage space than a lossy encoding. The latter, on the other hand, can still provide a high quality reproduction that may be perceptually indistinguishable from the original.

Redundant Description:

An alternative approach is to include an explicit encoding of certain privileged objects A in the code stream, which would therefore consist of $E(C), E(A), E(B_1), E(B_2), \ldots, E(B_m)$. Assuming E is lossy, this approach is likely to be more economical than using a lossless encoding, but is still not an efficient use of bandwidth. The approach is redundant, since E(C) is obviously correlated to the individually encoded objects $E(A), E(B_1), E(B_2), \ldots, E(B_m)$.

SUMMARY OF THE INVENTION

Lossy compression and transmission of a downmixed composite signal having multiple tracks and objects, including a downmixed signal, is accomplished in a manner that reduces the bit-rate requirement as compared to redundant transmission or lossless compression, while reducing upmix artifacts. A compressed residual signal is generated and transmitted along with a compressed total mix and at least one compressed audio objects. In the reception and upmix aspect the invention decompresses a downmixed signal and other compressed objects, calculates an approximate upmix signal, and corrects specific base signals derived from the upmix, by subtracting a decompressed residual signal. The invention thus allows lossy compression to be used in combination with downmixed audio signals for transmission through a communication channel (or for storage). Upon later reception and upmix, additional base signals are recoverable in capable systems providing multi-object capability (while legacy systems can easily decode a total mix without upmix). The method and apparatus of the invention have both a) audio compression and downmixing aspects, and b) an audio decompression/upmixing aspect, wherein compression should be understood to denote a method of bit-rate reduction (or file size reduction), and wherein downmixing denotes a reduction in channel or object count, while upmixing denotes an increase in channel count by recovering and separating a previously downmixed channel or object.

In its decompression and upmixing aspect, the invention includes a method for decompressing and upmixing a compressed and downmixed composite audio signal. The method includes the steps: receiving a compressed representation of a total mix signal C, a set of compressed representations of a respective set of object signals {Bi} (said set having at least one member), and a compressed representation of a residual signal Δ; decompressing the compressed representation of the total mix signal C, decompressing the set of object signals {Bi} and the compressed representation of residual signal Δ to obtain respective approximate total mix signal C', a set of approximate object signals {Bi'}, and a reconstructed residual signal Δ'; subtractively mixing the approximate total mix signal C' and the complete set of approximate object signals {Bi'} to obtain an approximation R' of a base signal R; and subtractively mixing said reconstructed residual signal Δ' with the approximation R' of reference signal R to yield a corrected base signal A". In a preferred embodiment, at least one of the compressed representations of C and of at least one Bi are prepared by a lossy method of compression.

In its compression and downmixing aspect, the invention includes a method of compressing a composite audio signal comprising a total mix signal C, a set of at least one object signals {Bi} (said set having at least one member Bi), and a base signal A, wherein the total mix signal C comprises a base signal A mixed with said set of at least one object signals {Bi} according to the steps: compressing the total mix signal C and the set of at least one object signals {Bi} by a lossy method of compression to produce a compressed total mix signal E(C) and a compressed set of object signals E({Bi}), respectively; decompressing said compressed total mix signal E(C) and the set of compressed object signals E({Bi}) to obtain reconstructed Q(C) and a reconstructed set of object signals Q({Bi}); subtractively mixing the reconstructed signal Q(C) and the complete set of object signals Q({Bi}) to produce an approximate base signal Q'(A); and subtracting a reference signal from the approximate base signal to yield a residual signal Δ, then compressing the residual signal Δ to obtain a compressed residual signal Ec(Δ). The compressed total mix signal E(C), the set of (at least one) compressed object signals E({Bi}), and the compressed residual signal Ec(Δ) are preferably transmitted (or equivalently, stored or recorded).

In one embodiment of the compression and downmix aspect, the reference signal comprises the base mix signal A. In an alternate embodiment, the reference signal is an approximation of the base signal A derived by compressing base signal A by a lossy method to form a compressed signal E(A), then decompressing the compressed signal E(A) to obtain a reference signal (which is an approximation of base signal A).

This summary is provided to introduce a selection of concepts in a simplified form that are further described below in the Detailed Description. This summary is not intended to identify key features or essential features of the claimed subject matter, nor is it intended to be used to limit the scope of the claims. As used in this application, unless the context clearly demands otherwise, the term "set" is used to denote a set having at least one member, but not necessarily required to have a plurality of members. This sense is commonly used in mathematical contexts and should not cause ambiguity. These and other features and advantages of the invention will be apparent to those skilled in the art from the following detailed description of preferred embodiments, taken together with the accompanying drawings, in which:

BRIEF DESCRIPTION OF THE DRAWINGS

FIG. 1 is a high level block diagram depicting a generalized system for compressing and transmitting composite signals including mixed audio signals in a backward compatible manner, as known in the prior art;

FIG. 2 is a flow diagram showing the steps of a method for compressing a composite audio signal in accordance with a first embodiment of the invention;

FIG. 3 is a flow diagram showing the steps of a method for decompressing and upmixing audio signals, in accordance with a decompression aspect of the invention;

FIG. 4 is a flow diagram showing steps of a method for compressing a composite audio signal in accordance with an alternate embodiment of the invention;

FIG. 5 is a schematic block diagram of an apparatus for compressing a composite audio signal in accordance with an alternate embodiment of the invention, consistent with the method of FIG. 2; and FIG. 6 is a schematic block diagram of an apparatus for compressing a composite audio signal in accordance with a first embodiment of the invention, consistent with the method of FIG. 4.

DETAILED DESCRIPTION OF THE INVENTION

The methods described herein concern processing signals, and are particularly directed to processing audio signals representing physical sound. These signals can be represented by digital electronic signals. In the discussion, continuous mathematical formulations may be shown or discussed to illustrate the concepts; however, it should be understood that some embodiments operate in the context of a time series of digital bytes or words, said bytes or words forming a discrete approximation of an analog signal or (ultimately) a physical sound. The discrete, digital signal corresponds to a digital representation of a periodically sampled audio waveform. In an embodiment, a sampling rate of approximately 48 thousand samples/second may be used. Higher sampling rates such as 96 khz may alternatively be used. The quantization scheme and bit resolution can be chosen to satisfy the requirements of a particular application. The techniques and apparatus described herein may be applied interdependently in a number of channels. For example, they can be used in the context of a surround audio system having more than two channels.

As used herein, a "digital audio signal" or "audio signal" does not describe a mere mathematical abstraction, but, in addition to having its ordinary meaning, denotes information embodied in or carried by a non-transitory, physical medium capable of detection by a machine or apparatus. This term includes recorded or transmitted signals, and should be understood to include conveyance by any form of encoding, including pulse code modulation (PCM), but not limited to PCM. Outputs or inputs, could be encoded or compressed by any of various known methods, including MPEG, ATRAC, AC3, or the proprietary methods of DTS, Inc. as described in U.S. Pat. Nos. 5,974,380; 5,978,762; and 6,487,535. Some modification of the calculations may be performed to accommodate that particular compression or encoding method.

Overview:

FIG. 1 shows the general environment within which the invention operates, at a high level of generalization. As in the prior art, an encoder 110 receives a plurality of independent audio signals referred to arbitrarily as A, B, downmixes said signals to a total mix signal C (=A+B) with a mixer 120, compresses the downmixed signals with compressor 130, then transmits (or record) the downmixed signals in a manner that will allow reconstruction of a reasonable approximation of the signals at a decoder 160. Although only on signal B is shown in the drawings (for simplicity), the invention can be used with a plurality of independent signals or objects $B_1, B_2, \ldots B_m$. Similarly, in the description which follows we refer to a set of objects $B_1, B_2, \ldots B_m$; it should be understood that the set of objects consists of at least one object, i.e. m>=1, not limited to a certain number of objects.

In addition to encoder 110 and decoder 160, FIG. 1 shows a generalized transmission channel 150, which should be understood to include any means of transmission or recording or storage medium, particularly recording onto a non-transitory, machine-readable storage medium. In the context of the invention, and in communication theory more generally, recording or storage combined with later playback can be considered a special case of information transmission or communication, it being understood that the reproduction corresponds to receiving and decoding the coded information generally at a later time and optionally in a different spatial location. Thus, the term "transmit" can denote recording on a storage medium; "receive" can denote reading from a storage medium; and "channel" can include information storage on a medium.

It is important that the signals be transmitted through the transmission channel in a multiplexed format to maintain and preserve the synchronous relationship between the signals (A, B, C). The multiplexer and demultiplexer could include combinations of bit-packing and data formatting methods known in the art. The transmission channel can also include other layers of information coding or processing, such as error correction, parity checking or other techniques as appropriate to the channel or physical layers as described in the OSI layer model (for example).

As shown, a decoder receives compressed and downmixed audio signals, demultiplexes said signals, decompresses said signals in an inventive manner that allows acceptable reconstruction of an upmix to reproduce a plurality of independent signal (or audio objects). The signals are then preferably upmixed to recover the original signals (or as close an approximation as possible).

Theory of Operation:

Assume A, $B_1, B_2, \ldots, B_m$ are independent signals (objects), which are encoded in a code stream and sent to a renderer. Distinguished object A will be referred to as the base object, while $B=B_1, B_2, \ldots, B_m$ will be referred to as regular objects. We refer to a set of objects $B_1, B_2, \ldots, B_m$; but it should be understood the set of objects contains at least one object (i.e. m>=1), not limited to a certain number of objects. In an object-based audio system, we are interested in rendering objects simultaneously but independently, so that, for example, each object could be rendered at a different spatial location.

For backward compatibility, we require that the coded stream be interpretable by legacy systems that are neither object-based nor object-aware. Such systems can only render the composite object $C=A+B_1+B_2+\ldots+B_m$ from an encoded version, E(C), of C. Therefore, we require that the transmitted code stream include E(C), followed by descriptions of the individual objects, which are ignored by the legacy systems. In prior art methods the code stream would consist of E(C) followed by descriptions $E(B_1)$, $E(B_2), \ldots, E(B_m)$ of the regular objects. The base object A would then recovered by decoding these descriptions and setting $A=C-B_1-B_2-\ldots-B_m$. It should be noted, however, that most audio codecs used in practice are lossy, meaning that the decoded version Q(X)=D(E(X)) of a coded object E(X) is only an approximation of X, and not necessarily identical to it. The accuracy of the approximation generally depends on the choice of codec {E,D} and on the bandwidth (or storage space) available for the code stream.

It follows, therefore, that when using a lossy encoder, the decoder will not have access to the objects C, $B_1, B_2, \ldots,$ $B_m$, but to approximate versions Q(C), $Q(B_1)$, $Q(B_2)$, . . . , $Q(B_m)$, and will only be able to estimate A as $$Q'(A)=Q(C)-Q(B_1)-Q(B_2)- \ldots -Q(B_m).$$

Such an approximation will suffer from the accumulation of the errors in the individual lossy encodings. This will often result, in practice, in objectionable perceptual artifacts. In particular, Q'(A) may be a significantly worse approximation of A than Q(A), and its artifacts may be statistically correlated to the other objects, which is not the case with Q(A). In practice the residual C−B1−B2 etc. will be audibly correlated to B1+B2+ . . . (for lossy compression). Our human ears can pick up correlations that are hard to detect algorithmically.

In accordance with the invention, some of the redundancy mentioned in connection with prior approaches is avoided, while still allowing for an acceptable reconstruction of A. Instead of including a (redundant signal) Q(A) in the code stream, we include an encoding $E_c(\Delta)$, where Δ is the residual signal:

$$\Delta=Q'(A)-A,$$

and $E_c$ is a lossy encoder for Δ (not necessarily the same as E). Let $D_c$ be a decoder for $E_c$, and let $$R(\Delta)=D_c(E_c(\Delta)).$$

On the decoder side, an approximation of A is obtained as $$Q_c(A)=Q'(A)-R(\Delta).$$

Method of First Embodiment

1. Encoder

The method of encoding described mathematically above can be procedurally described as a sequence of actions, as shown in FIG. 2. As previously described, at least one distinguished object A will be referred to as the base object, while $B_1$, $B_2$, . . . , $B_m$ will be referred to as regular objects. For brevity, we may refer to the regular objects collectively as B below, it being understood that the set of all (at least one) regular objects $B_1$, $B_2$, . . . , $B_m$ may be designated as {Bi}; In contrast, B=B1+B2+ . . . Bm denotes the mix of regular object $B_1$, $B_2$, . . . , $B_m$. The method begins with a mixed signal C=A+B. It will be apparent that the mixing of A+B could be done as a preliminary step, or the signals could be provided as previously mixed. The signal A is also needed; it can be either separately received or reconstructed by subtraction of B from C. The set of (at least one) regular objects {Bi} is also required and used by the encoder as described below.

First, the encoder compresses (step 210) signals A, {Bi} and C separately using a lossy encoding method to obtain corresponding compressed signals denoted E(A), {E(Bi)}, and E(C) respectively. (The notation {E(Bi)} denotes the set of encoded objects each corresponding with a respective original object belonging to the set of signals {Bi}, each object signal individually encoded by E). The encoder next decompresses (step 220) E(C) and {E(Bi)} by a method complementary to that used to compress C and {Bi}, to yield reconstructed signals Q(C) and {Q(Bi)}. These signals approximate the original C and {Bi} (differing because they were compressed then decompressed using a lossy method of compression/decompression. {Q(Bi)} is then subtracted from Q(C) by subtractive mixing step 230 to yield a modified upmix signal Q'(A), which is an approximation of original A differing from A by errors introduced in lossy coding followed by mixing. Next, signal A (a reference signal) is subtracted from the modified upmix signal Q'(A) in a second mixing step 240 to obtain a residual signal Δ=Q'(A)−A (step 130). The residual signal Δ is then compressed (step 250) by a compression method we designate as Ec, where Ec is not necessarily the same compression method or device as E (used in step 210 to compress the signals A, {Bi}, or C). Preferably, to decrease bandwidth requirements Ec should be a lossy encoder for Δ chosen to match the characteristics of Δ. However, in an alternate embodiment less optimized for bandwidth, Ec could be a lossless compression method.

Note that the method described above requires successive compression and decompression steps 210 and 220 (as applied to signals {Bi} and C). In these steps, and in the alternative method described below, computation complexity and time may in some instances be reduced by only performing the lossy portions of the compression (and decompression). For example, many lossy methods of decompression such as the DTS codec described in U.S. Pat. No. 5,974,380 require successive applications of both lossy steps (filtering into subbands, bit allocation, requantization in subbands) followed by lossless steps (applying a codebook, entropy reduction). In such instance it is sufficient to omit the lossless steps on both encode and decode, merely performing the lossy steps. The reconstructed signal would still exhibit all of the effects of lossy transmission, but many computational steps are saved.

The encoder then transmits (step 260) R=Ec(Δ), E(C) and {E(Bi)}. Preferably the encoding method also includes optional step of multiplexing or reformatting the three signals into a multiplexed package for transmission or recording. Any of known methods of multiplexing could be used, provided that some means is used to preserve or reconstruct the temporal synchronization of the three separate but related signals. It should be borne in mind that the different quantization scheme might be used for all three signals, and that bandwidth may be distributed among the signals. Any of the many known methods of lossy audio compression could be used for E, including MP3, AAC, WMA, or DTS (to name only a few).

This approach offers at least the following advantages: first, the "error" signal Δ is expected to be of smaller power and entropy than the original objects. Having reduced powered compared to A, the error signal Δ can be encoded with fewer bits than the object A it helps to reconstruct. Therefore, the proposed approach is expected to be more economical than the redundant description method discussed above (in the Background section). Second, the encoder E can be any audio encoder (e.g., MP3, AAC, WMA, etc.), and especially note that the encoder can be, and in preferred embodiments is a lossy encoder employing psychoacoustic principles. (The corresponding decoder would of course also be a corresponding lossy decoder). Third, the encoder E need not be a standard audio encoder, and can be optimized for the signal Δ, which is not a standard audio signal. In fact, the perceptual considerations in the design and optimization of $E_c$ will be different from those in the design of a standard audio codec. For example, perceptual audio codecs do not always seek to maximize SNR in all parts of the signal; instead, a more "constant" instantaneous SNR regime is sometimes sought, where larger errors are allowed when the signal is stronger. In fact, this is a major source of the artifacts resulting from the $B_i$ which are found in Q'(A). With $E_c$, we seek to eliminate these artifacts as much as possible, so a straight instantaneous SNR maximization seems more appropriate in this case.

The decoding method in accordance with the Invention is shown if FIG. 3. As a preliminary, optional step 300, the decoder must receive and demultiplex the data stream to recover Ec(Δ), {E(Bi)} and E(C). First, (step 310) the decoder receives the compressed data streams (or files) Ec(Δ), {E(Bi)} and E(C). Next the decoder will decompress (step 320) each of the data streams (or files) Ec(Δ), {E(Bi)} and E(C) to obtain reconstructed representations {Q(Bi)}, Q(C) and Rc(Δ)=Dc(Ec(Δ)) where Dc is the decompression method inverse to the compression method Ec, and where decompression methods for {E(Bi)} and E(C) are those complementary to the compression methods used for {Bi} and C The signals Q(C) and {Q(Bi)} are mixed subtractively (step 330) to recover Q'(A)=Q(C)−ΣQ(Bi). This signal Q'(A) is an approximation of A differing from original A because it was reconstructed from a subtractive mix of Q(C) and {Q(Bi)}, both of which were transmitted by lossy codec methods. In the decoding and upmix method of the invention, the approximation signal Q'(A) is then improved by subtracting (step 340) the reconstructed residue R(Δ) to obtain Qc(A)=Q'(A)−R(Δ). The recovered replica signals Qc(A), Q(C), {Q(Bi)} can then be reproduced or output for reproduction (step 350) as an upmix (A, {Bi}). The downmix signal Q(C) is also available for output for systems having fewer channels (or as a choice based on consumer control or preference).

It will be appreciated that the method of the invention does require transmission of some redundant data. However, the file size (or bit rate requirement) for the method of the invention is less than that required to either a) use lossless coding for all channels, or b) transmit a redundant description of lossy coded objects plus lossy coded upmix. In one experiment, the method of the invention was used to transmit an upmix A+B (for a single object B), together with base channel A. The results are shown in Table 1. It can be seen that redundant description (prior art) method would require 309 KB to transmit the mix; in contrast, the method of the invention would require only 251 KB for the same information (plus some minimal overhead for multiplexing and header fields). This experiment does not represent the limits of improvement that might be obtained by further optimizing the compression methods.

In an alternative embodiment of the method, as shown in FIG. 4, the method of encoding differs in that the residual signal Δ is derived from the difference between Q'(A)=D(E(C))−ΣD(E(Bi)) and Q(A) (instead of A). This embodiment is particularly appropriate in an application in which the reconstruction of A is desired and expected to reach approximately the same quality as the reconstruction of B and C (there is no need to strive a higher fidelity reconstruction of A). This is often the case in an audio entertainment system.

Note that in the alternative embodiment, Q'(A) is the signal reproduced by taking the difference between a) the encoded then decoded version of the C downmix, and b) the reconstructed base objects {Q(Bi)} reproduced by decoding the lossy encoded base mix B.

Referring now to FIG. 4, in the alternative of the method, the encoder compresses (step 410) signals A, {Bi}, and C separately using a lossy encoding method to obtain three corresponding compressed signals denoted EA, {E(Bi)} and E(C) respectively. The encoder next decompresses E(A) (step 420) by a method complementary to that used to compress A yielding Q(A) which is an approximation of A (differing because it was compressed then decompressed using a lossy method of compression/decompression). The alternative method then decompresses (step 430) both E(C) and {E(Bi)} by respective methods complementary to those used to encode C and {Bi}. The resulting reconstructed signals Q(C) and {Q(Bi)} are approximations to the original {Bi} and C, differing because of imperfections introduced by the lossy encoding and decoding methods. The alternative method next in step 440 subtracts ΣQ(Bi) from Q(C) to obtain the difference signal Q'(A). Q'(A) is another approximation of A, differing because of the lossy compression was used on the transmitted downmix. A residual signal Δ is obtained (step 450) by subtracting Q(A) from Q'(A).

The residual signal Δ is then compressed step 460 by the encoding method Ec (which could differ from E). As in the first embodiment described above, Ec is preferably a lossy codec suited to the characteristics of the residual signal. The encoder then transmits (step 470) R=Ec(Δ), E(C) and {E(Bi)} through a transmission channel with the synchronous relationship preserved. Preferably the encoding method also includes multiplexing or reformatting the three signals into a multiplexed package for transmission or recording. Any of known methods of multiplexing could be used, provided that some means is used to preserve or reconstruct the temporal synchronization of the three separate but related signals. It should be borne in mind that different quantization scheme might be used for all three signals, and that bandwidth may be distributed among the signals. Any of the many known methods of audio compression could be used for E, including MP3, AAC, WMA, or DTS (to name only a few).

Signals encoded by the alternate encoding method can be decoded by the same decoding method described above in connection with FIG. 3. The decoder will subtract the reconstructed residual signal to improve the approximation of the upmix signal, Q(A), thereby reducing the difference between the reconstructed replica signal Q(A) and the original signal A. Both embodiments of the invention are united by the generality that they generate at the encoder a residual or error signal Δ representing the difference to be expected after decoding and upmixing a signal to extract a privileged object A. The error signal Δ is in both embodiments compressed and transmitted (or equivalently, recorded or stored). In both embodiments the decoder decompresses the compressed error signal Δ and subtracts it from the reconstructed upmix signal approximating the privileged object A.

The method of the alternative embodiment may have some perceptual advantages in certain applications. Which of the alternatives is preferable in practice may depend on the specific parameters of the system and the specific optimization objectives.

In another aspect, the invention includes an apparatus for compressing or encoding mixed audio signals as shown in FIG. 5. In a first embodiment of the apparatus, Signals C (=A+B object mix) and B are provided at input 510 and 512, respectively. Signal C is encoded by encoder 520 to produce encoded signal E(C); Signals {Bi} are encoded by encoder 530 to produce second encoded signal {E(Bi)}. E(C) and {E(Bi)} are then decoded by decoders 540 and 550, respectively, to yield reconstructed signals Q(C) and {Q(Bi)}. The reconstructed signals Q(C) and {Q(Bi)} are mixed subtractively in mixer 560 to yield the difference signal Q'(A). This difference signal differs from the original signal A in that it is obtained by mixing from a reconstructed total mix Q(C) and the reconstructed objects {Q(Bi)}; artifacts or errors are introduced both because the encoder 520 is a lossy encoder, and because the signal is derived by subtraction (in mixer 560). The reconstructed signal Q'(A) is then subtracted from signal A (input to 570) and the difference δ is compressed by a second encoder 580—which in a preferred embodiment operates by a different method than compressor 520—to produce a compressed residual signal Ec(Δ).

In an alternate embodiment of the encoder apparatus, shown in FIG. 6, Signals C (=A+B object mix) and B are provided at input 510 and 512, respectively. Signal C is encoded by encoder 520 to produce encoded signal E(C); Signals {Bi} are encoded by encoder 530 to produce second encoded signal E(B). E(C) and {E(Bi)} are then decoded by decoders 540 and 550, respectively, to yield reconstructed signals Q(C) and {Q(Bi)}. The reconstructed signals Q(C) and Q(B) are mixed subtractively in mixer 560 to yield the difference signal Q'(A). This difference signal differs from the original signal A in that it is obtained by mixing from a reconstructed total mix Q(C) and the reconstructed objects {Q(Bi)}; artifacts or errors are introduced both because the encoder 520 is a lossy encoder, and because the signal is derived by subtraction (in mixer 560). Thus far the alternate embodiment resembles the first embodiment.

In the alternate embodiment of the apparatus, signal A received at input 570 is encoded by encoder 572 (which may be the same or operate by the same principles as lossy encoders 520 and 530) then encoded output of 572 is again decoded by a complementary decoder 574 to produce a reconstructed approximation Q(A) which differs from A because of the lossy nature of encoder 572. The reconstructed signal Q(A) is then subtracted from Q'(A) in mixer 560, and the resulting residual signal is encoded by second encoder 580 (different method from that used in lossy encoders 520 and 530). The outputs E(C), {E(Bi)} and E(Δ) are then made available for transmission or recording, preferably in some multiplexed format or any other method that permits synchronization.

It will be apparent that content encoded by first or alternate methods or encoding apparatus (FIG. 6) can be decoded by the decoder of FIG. 3. The decoder requires a compressed error signal, but need not be sensitive to the way in which the error is calculated. This leaves opportunity for future improvement in the codec without changing the decoder design.

The methods described herein may be implemented in a consumer electronics device, such as a general purpose computer, digital audio workstation, DVD or BD player, TV tuner, CD player, handheld player, Internet audio/video device, a gaming console, a mobile phone, headphones, or the like. A consumer electronic device can include a Central Processing Unit (CPU), which may represent one or more types of processors, such as an IBM PowerPC, Intel Pentium (x86) processors, and so forth. A Random Access Memory (RAM) temporarily stores results of the data processing operations performed by the CPU, and may be interconnected thereto typically via a dedicated memory channel. The consumer electronic device may also include permanent storage devices such as a hard drive, which may also be in communication with the CPU over an I/O bus. Other types of storage devices such as tape drives or optical disk drives may also be connected. A graphics card may also be connected to the CPU via a video bus, and transmits signals representative of display data to the display monitor. External peripheral data input devices, such as a keyboard or a mouse, may be connected to the audio reproduction system over a USB port. A USB controller can translate data and instructions to and from the CPU for external peripherals connected to the USB port. Additional devices such as printers, microphones, speakers, headphones, and the like may be connected to the consumer electronic device.

The consumer electronic device may utilize an operating system having a graphical user interface (GUI), such as WINDOWS from Microsoft Corporation of Redmond, Wash., MAC OS from Apple, Inc. of Cupertino, Calif., various versions of mobile GUIs designed for mobile operating systems such as Android, and so forth. The consumer electronic device may execute one or more computer programs. Generally, the operating system and computer programs are tangibly embodied in a non-transitory, computer-readable medium, e.g. one or more of the fixed and/or removable data storage devices including the hard drive. Both the operating system and the computer programs may be loaded from the aforementioned data storage devices into the RAM for execution by the CPU. The computer programs may comprise instructions which, when read and executed by the CPU, cause the same to perform the steps to execute the steps or features of embodiments described herein.

Embodiments described herein may have many different configurations and architectures. Any such configuration or architecture may be readily substituted. A person having ordinary skill in the art will recognize the above described sequences are the most commonly utilized in computer-readable mediums, but there are other existing sequences that may be substituted.

Elements of one embodiment may be implemented by hardware, firmware, software or any combination thereof. When implemented as hardware, embodiments described herein may be employed on one audio signal processor or distributed amongst various processing components. When implemented in software, the elements of an embodiment can include the code segments to perform the necessary tasks. The software can include the actual code to carry out the operations described in one embodiment or code that emulates or simulates the operations. The program or code segments can be stored in a processor or machine accessible medium or transmitted by a computer data signal embodied in a carrier wave, or a signal modulated by a carrier, over a transmission medium. The processor readable or accessible medium or machine readable or accessible medium may include any medium that can store, transmit, or transfer information. In contrast, a computer-readable storage medium or non-transitory computer storage can include a physical computing machine storage device but does not encompass a signal.

Examples of the processor readable medium include an electronic circuit, a semiconductor memory device, a read only memory (ROM), a flash memory, an erasable ROM (EROM), a floppy diskette, a compact disk (CD) ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc. The machine accessible medium may be embodied in an article of manufacture. The machine accessible medium may include data that, when accessed by a machine, cause the machine to perform the operation described in the following. The term "data," in addition to having its ordinary meaning, here refers to any type of information that is encoded for machine-readable purposes. Therefore, it may include program, code, a file, etc.

All or part of various embodiments may be implemented by software executing in a machine, such as a hardware processor comprising digital logic circuitry. The software may have several modules coupled to one another. The hardware processor could be a programmable digital microprocessor, or specialized programmable digital signal processor (DSP), a field programmable gate array, an ASIC, or other digital processor. In one embodiment, for example, all of the steps of a method in accordance with the invention (either in encoder aspect or decoder aspect) could suitably be carried out by one or more programmable digital computers executing all of the steps sequentially under software control. A software module can be coupled to another module to receive variables, parameters, arguments, pointers, etc. and/or to generate or pass results, updated variables, pointers, etc. A software module may also be a software driver or interface to interact with the operating system running on the platform. A software module may also include a hardware driver to configure, set up, initialize, send, or receive data to and from a hardware device.

Various embodiments may be described as one or more processes, which may be depicted as a flowchart, a flow diagram, a structure diagram, or a block diagram. Although a block diagram may describe the operations as a sequential process, many of the operations can be performed in parallel or concurrently. In addition, the order of the operations may be re-arranged. A process is terminated when its operations are completed. A process may correspond to a method, a program, a procedure, or the like.

Throughout this application, reference has been frequently made to addition, subtraction or "subtractively mixing" signals. It will be readily recognized that signals may be mixed in various ways with equivalent results. For example, to subtract an arbitrary signal F for G (G−F), one can either subtract directly using differential inputs, or one can equivalently invert one of the signals, then add (example: G+(−F)). Other equivalent operations can be conceived, some including the introduction of phase shifts. Terms such as "subtract" or "subtractively mixing" are intended to encompass such equivalent variations. Similarly, variant methods, of signal addition are possible and contemplated as "mixing."

While several illustrative embodiments of the invention have been shown and described, numerous variations and alternate embodiments will occur to those skilled in the art. Such variations and alternate embodiments are contemplated and can be made without departing from the spirit and scope of the invention as defined in the appended claims.

We claim:

1. A method of decompressing and upmixing a compressed and downmixed, composite audio signal, comprising the steps:

receiving a compressed representation of a total mix signal C, a compressed representation of a residual signal Δ; and a set of compressed representations of respective object signals {Bi};

wherein the set of compressed representations of at least one object signal includes at least one compressed representation of a corresponding object signal Bi;

decompressing the compressed representation of the total mix signal and the compressed representation of the residual signal, to obtain an approximate total mix signal C';

decompressing the compressed representation of the residual signal Δ to obtain a reconstructed residual signal;

decompressing the set of compressed representations object signal {Bi} to obtain a set of object signals {Bi'}, said set having one or more object signals Bi' as members;

subtractively mixing the approximate total mix signal C' and the complete set of object signals {Bi'} to obtain a first approximation of a base signal A'; and subtractively mixing the reconstructed residual signal with the first approximation of the base signal, to obtain an improved approximation of the base signal.

2. The method of claim 1, wherein said set of compressed representations of object signals comprises one compressed representation of a corresponding object signal.

3. The method of claim 1, wherein at least one of the compressed representations is prepared by a lossy method of compression.

4. The method of claim 3 wherein the compressed representation of the residual signal Δ is prepared by:

subtractively mixing a reference signal R with a reconstructed approximation A' of a base signal A to obtain a residual signal Δ representing the difference; and compressing the residual signal Δ.

5. The method of claim 4 wherein the reference signal comprises the base signal A.

6. The method of claim 4 wherein the reference signal comprises an approximation of the base signal A.

7. The method of claim 1 further comprising:

causing at least one of the corrected base signal A', the reconstructed object signals {Bi}, and the approximate total mix signal C' to be reproduced as a sound.

8. The method of claim 1, wherein

The step of decompressing the set of compressed representations of at respective object signals {Bi} comprises decompressing a plurality compressed representations to obtain a respective plurality of object signals {Bi'}; and wherein said step of subtractively mixing the approximate total mix signal C' and the complete set of object signals includes subtracting from C' the complete plurality of object signals {Bi'}, to obtain the first approximation of the base signal.

9. The method of claim 8, wherein at least one of the compressed representations is prepared by a lossy method of compression.

10. The method of claim 9 wherein the compressed representation of the residual signal Δ is prepared by:

subtractively mixing a reference signal R with a reconstructed approximation A' of a base signal A to obtain a residual signal Δ representing the difference; and compressing the residual signal Δ.

11. The method of claim 10 wherein the reference signal comprises the base signal A.

12. The method of claim 10 wherein the reference signal comprises an approximation of the base signal A.

13. The method of claim 8 further comprising:

causing at least one of the corrected base signal A', the reconstructed object signals {Bi}, and the approximate total mix signal C' to be reproduced as a sound.

14. A method of compressing a composite audio signal comprising a total mix signal C, a set of at least one object signals {Bi}, and a base signal A, wherein said total mix signal C comprises a base signal A mixed with the set of audio object signals {Bi}, said set of audio object signals {Bi} having at least one member object signal Bi, the method comprising the steps:

compressing the total mix signal C and the complete set of audio object signals {Bi} by a lossy method of compression, to produce compressed total mix signal E(C) and a compressed set of object signals E({Bi}), respectively;

decompressing the compressed total mix signal E(C) and the set of compressed object signals E({Bi}) to obtain a reconstructed Q(C) and a reconstructed set of at least one object signals Q({Bi});

subtractively mixing the reconstructed signal Q(C) and a complete mix of the set of reconstructed signals Q({Bi}) to produce an approximate base signal Q'(A);

subtracting a reference signal from said approximate base signal Q'(A) to yield a residual signal Δ; and Compressing the residual signal Δ to obtain a compressed residual signal Ec(Δ).

15. The method of claim 14, wherein said set of at least one object signals {Bi} comprises only one object signal.

16. The method of claim 15, further comprising the step:

Transmitting a composite signal comprising the compressed total mix signal E(C), the compressed object signal E({Bi}) and the compressed residual signal E(Δ).

17. The method of claim 15, wherein said reference signal comprises the base signal A.

18. The method of claim 15, wherein said reference signal comprises an approximation of the base signal A derived by compressing the base signal A by a lossy compression method, then decompressing to obtain an approximation of the base signal Q(A).

19. The method of claim 15 wherein said step of compressing the residual signal comprises compressing the residual signal by a method different from a method used to compress the total mix signal C.

20. The method of claim 14 wherein said set of at least one object signals {Bi} comprises a plurality of object signals.

21. The method of claim 20, wherein said reference signal comprises the base signal A.

22. The method of claim 20, wherein said reference signal comprises an approximation of the base signal A derived by compressing the base signal A by a lossy compression method, then decompressing to obtain an approximation of the base signal Q(A).

23. The method of claim 20 wherein said step of compressing the residual signal comprises compressing the residual signal by a method different from a method used to compress the total mix signal C.

24. A method to improve digital audio reproduction by refining an approximate audio base signal A derived from an approximate total mix signal C' and a set of approximately reconstructed audio object signals {Bi'} having at least one member signal Bi', the method comprising the steps:

decompressing a compressed representation of a residual signal E(Δ) to obtain a residual signal Δ;

subtractively mixing the approximate total mix signal C' and the complete set of approximately reconstructed object signals {Bi'} to obtain a first approximation of a base signal A'; and subtractively mixing the reconstructed residual signal Δ with the first approximation of the base signal A', to obtain an improved approximation of the base signal.

25. The method of claim 24 wherein the compressed representation of the residual signal E(Δ) is prepared by:

subtractively mixing a reference signal R with a reconstructed approximation A' of a base signal A to obtain a residual signal Δ representing the difference; and compressing the residual signal Δ.

26. The method of claim 25 wherein the reference signal comprises a base signal A.

27. The method of claim 25 wherein the reference signal comprises an approximation of the base signal A, prepared by compressing A by a lossy method then decompressing to obtain the reference signal R.

* * * * *